US010213815B1

(12) United States Patent
Baugh

(10) Patent No.: US 10,213,815 B1
(45) Date of Patent: Feb. 26, 2019

(54) METHOD OF CLEANING THE INLET TO A THRUSTER WHILE IN OPERATION

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 15/800,298

(22) Filed: Nov. 1, 2017

(51) Int. Cl.

| | |
|---|---|
| ***E02B 3/00*** | (2006.01) |
| ***E02B 5/08*** | (2006.01) |
| ***E02B 7/00*** | (2006.01) |
| ***E02B 8/08*** | (2006.01) |
| ***B08B 9/032*** | (2006.01) |
| ***E02B 3/04*** | (2006.01) |

(52) U.S. Cl.
CPC ..... *B08B 9/0321* (2013.01); *E02B 3/041* (2015.09)

(58) Field of Classification Search
CPC ..... E02B 3/00; E02B 5/08; E02B 7/00; E02B 8/08
USPC ..... 405/80, 81; 119/219
See application file for complete search history.

(56) References Cited

U.S. PATENT DOCUMENTS 1,173,568 A * 2/1916 Griffin ..... F04D 29/703 416/247 R
2,612,861 A * 10/1952 Burkey ..... A01K 79/02 119/219
2,623,610 A * 12/1952 Buechel ..... F02C 7/055 415/121.2
2,695,074 A * 11/1954 Kelly ..... B64D 33/02 160/188
2,751,881 A * 6/1956 Burkey ..... E02B 1/003 119/219
2,761,421 A * 9/1956 Burkey ..... E02B 1/003 119/219
2,928,497 A * 3/1960 Stockdale ..... F02C 7/055 415/121.2
3,343,368 A * 9/1967 Castoldi ..... B63B 13/02 440/46
3,658,028 A * 4/1972 Koons ..... B63H 5/14 440/67
3,671,022 A * 6/1972 Laird ..... B01F 3/04609 210/170.09
3,740,785 A * 6/1973 Latall ..... B08B 9/0497 15/104.12
3,889,624 A * 6/1975 Balius ..... B63H 5/165 440/72
4,029,049 A * 6/1977 Hillier ..... A01K 69/00 119/219
4,055,947 A * 11/1977 Gongwer ..... F04D 29/181 416/223 A
4,467,831 A * 8/1984 French ..... E21B 43/12 137/625.27

(Continued)

*Primary Examiner* — Benjamin F Fiorello
*Assistant Examiner* — Edwin J Toledo-Duran

(57) ABSTRACT

A method for the prevention or remediation of flooding waters in a geographic area using one or more thrusters to increase the velocity of a portion of the water in a channel draining the flooding waters away from the geographic area, mixing the portion of the accelerated waters back in to the remainder of the waters in the channel thereby increasing the average velocity of the waters in the drainage system and increasing the rate of removal of the flooding waters from the geographic area, the thrusters having the one or more inlets approximately at ninety degrees from the centerline of the thruster and cleaning the thruster inlets by reversing the flow through the thruster while the flooding waters are still passing the thruster.

29 Claims, 7 Drawing Sheets

(56) References Cited

U.S. PATENT DOCUMENTS 4,726,183 A * 2/1988 Gongwer ..... B64D 33/02 415/121.2
4,740,105 A * 4/1988 Wollander ..... E02B 1/006 405/83
5,048,445 A * 9/1991 Lever ..... B63B 59/10 114/222
5,083,948 A * 1/1992 Grobson ..... B63B 35/731 30/122
5,263,833 A * 11/1993 Robinson ..... E02B 8/085 405/81
5,431,122 A * 7/1995 Templet, Jr. ..... B63B 59/08 114/222
5,632,572 A * 5/1997 Chicha ..... E02B 8/08 405/81
5,673,449 A * 10/1997 Henriksson ..... E01D 19/02 14/75
5,720,824 A * 2/1998 Bronson ..... B08B 3/08 134/28
6,102,619 A * 8/2000 Truebe ..... A01K 79/02 405/81
6,132,270 A * 10/2000 Nagel ..... B63H 11/14 440/38
6,152,793 A * 11/2000 Gongwer ..... B63H 5/165 114/151
6,273,642 B1 * 8/2001 Anderson ..... E02F 5/105 405/163
6,352,455 B1 * 3/2002 Guagliano ..... B63H 11/06 417/412
6,729,800 B2 * 5/2004 Burns, II ..... E02B 1/003 119/219
6,736,572 B2 * 5/2004 Geraghty ..... E02B 1/003 405/211
7,419,334 B2 * 9/2008 Baugh ..... E02B 3/041 405/39
8,870,445 B2 * 10/2014 Burns, II ..... B01F 5/0212 366/163.2
2008/0022652 A1 * 1/2008 Blacklidge ..... F04B 7/04 60/221

* cited by examiner

METHOD OF CLEANING THE INLET TO A THRUSTER WHILE IN OPERATION

TECHNICAL FIELD

This invention relates to the method of using thrusters in waterways to control the flooding in and around bayous and rivers and more specifically to preventing the ingestion of trash into the thruster inlet.

BACKGROUND OF THE INVENTION

Conventional flood control is done by having a waterway such as bayous, rivers, or streams lead from the area in which it is raining toward the ocean, or in the case of the Houston area, to the Gulf of Mexico. As rain falls, water travels down to the lower parts of the waterway at a speed which is a function of the grade or slope of the waterway and the depth of the water, typically carrying a variety of debris with it. The more the grade or the difference in height from where the rain is falling to the ocean, the faster the water will flow and when water is deeper, more of the water is away from the wall effects and therefore it will flow faster as more and more rain falls. The waterway will become increasingly fuller until at some point the amount of water which will flow down to the waterway is exceeded by the amount of rain fall, and therefore you have a flood.

The elevation of the seawater the water is flowing to and the elevation of the area in which the rain is falling on are not variable for a specific location. Therefore, the conventional methods for increasing the amount of flow is by making the waterway larger, making it straighter so that the water will not be slowed down by making turns, and removing friction causing impediments from the waterway such as trees.

In the case of the Great Flood of 2001 in the City of Houston and Hurricane Harvey in 2017, the elevation between the flooded area and the Gulf of Mexico was about 24 feet above sea level and the distance from the flooded area to the Gulf Mexico was about 20 miles. So, the driving force of the rainwater was a head of about 24 feet. It literally would not do a substantial amount of good to make the waterway significantly deeper because if the waterway were significantly deeper it would potentially be below sea level. To make the waterway progressively wider to increase the volume in a highly urbanized area is a massive investment in the purchase of land and the movement of earth, and the changes to other civil engineering structures such as bridges and roads.

This invention will be primarily discussed in terms of the sites specific application of Houston, Tex. and the floods of 2001 and 2017. However, it can be applied to a number of other localities such as even flooding on the Mississippi River can be prevented by the methods discussed herein.

Flooding is caused because water is concentrated in an area and is not caused to move out of that area to the sea. That is an obvious statement, but it is a statement well worth considering. If we take one pound of water in the middle of the flood in Houston and desire to deliver it to the Gulf of Mexico at sea level, it will be reduced in height by the amount of the elevation in Houston to the elevation of sea level or about 24 feet. In other words, it will give up about 24 foot-pounds of energy in the transportation from Houston to the Gulf of Mexico. Where do the 24-foot pounds go? The 24 foot-pounds of energy goes to frictional losses moving down Buffalo Bayou from Houston to the Gulf of Mexico. A certain amount of the energy is retained in kinetic energy as it has a velocity as it enters the Gulf of Mexico and so some part of the energy is given up due to frictional losses traveling down Buffalo Bayou some of it is kinetic energy which dissipates into the Gulf of Mexico as it arrives at the Gulf of Mexico. Pound for pound this says that each pound of water in the middle of the flood has 24 pound-feet of energy available to drive itself from the flooded area to the Gulf of Mexico. This additionally says that in the flooded situation in the City of Houston with the volume of water to be handled at that time, 24 foot-pounds of energy is not enough to drive the water away fast enough to prevent flooding. We literately have an objective measure that says this is not enough energy, not enough horsepower or however you want to say it, to get the job done.

SUMMARY OF THE INVENTION

The object of this invention is to provide a means to minimize and or completely eliminate flooding from occurring in an area such as Houston, even in a 500 year rain scenario such as happened in 2001 or a 1000 year rain scenario such as happened in 2017.

A second objective is to provide means to eliminate flooding at a economic cost. In this particular case in Houston, $4.8 billions of cost were incurred in the City of Houston. But the one number that is of particular interest is at the University of Houston. It is estimated that two hundred and fifty million dollar's worth of flood damage was done in this one site alone. It is a suggestion of this application that an investment of the same two hundred and fifty million dollars in the greater Houston area would eliminate all significant flooding permanently.

Another object of this invention is not to do great civil engineering projects that digs great ditches to carry the flow away but rather provide enough energy or enough horsepower to move the water fast enough in currently available waterways so that the flooding does not occur.

Another objective of this invention is to make the system tolerant to the types of debris which will naturally be carried in the flood waters, both floating and submerged.

BRIEF DESCRIPTION OF THE DRAWINGS

FIG. 2 is a view of the same general area in which the bayous are full and flooding has occurred both in the downtown area and in the University of Houston area. The thruster packages of this invention are shown in place, but not turned on.

FIG. 3 is a view of the same general area with the flooding remedied by turning the thrusters on.

DESCRIPTION OF THE PREFERRED EMBODIMENT

Figure 1:
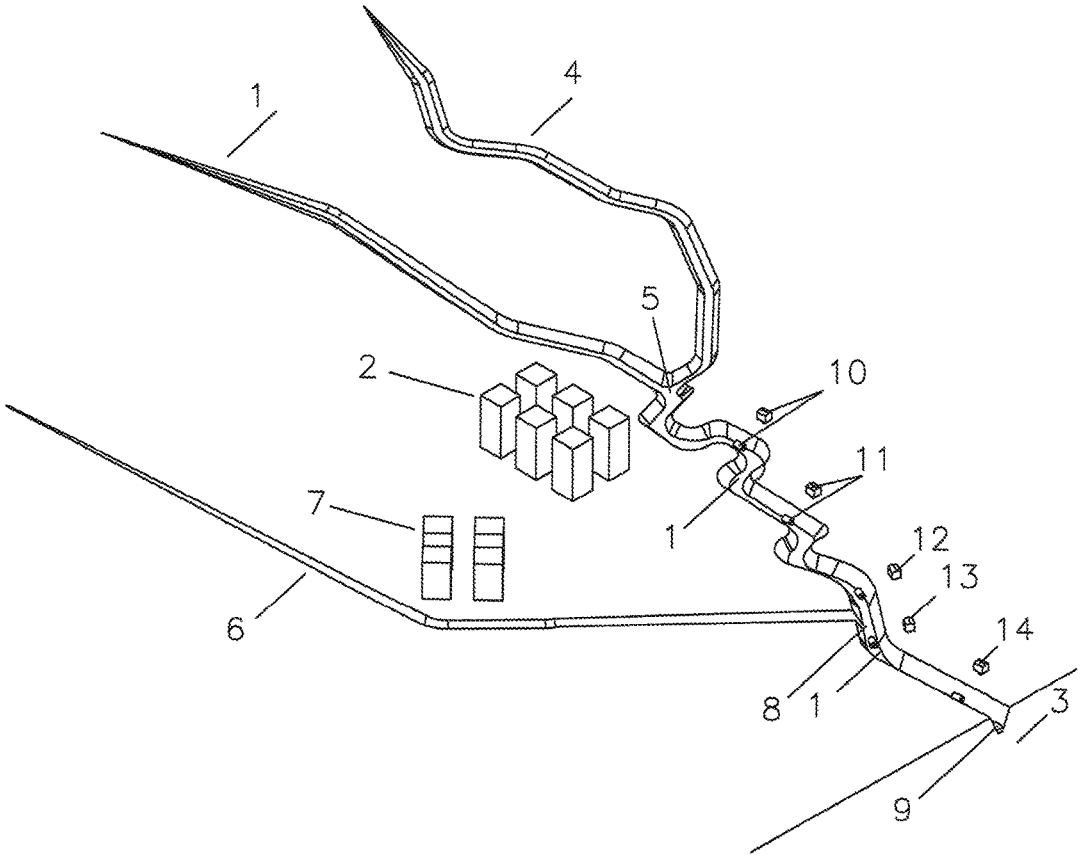
FIG. 1 is a view of the general geographic area of Houston showing water flowing normally past downtown in Buffalo Bayou and by the University of Houston flowing in Brays Bayou, and finally in the bay system and into the Gulf of Mexico. The thruster packages of this invention are shown in place on Buffalo Bayou only.

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

How do we input power into water in open channels? Remote subsea vehicles, thrusters on great vessels and even propellers on large ships are means to put energy into water, to cause water to move in one direction, normally with the objective of moving the vessel in the opposite direction. Literally a propeller takes a small poundage of water and throws it to the rear of the ship. That energy of throwing the water to the rear of the ship causes an equal reaction in the opposite direction and provides force to move the ship forward. One can see the water speeding from the propeller at rear of a boat. Imagine that a giant propeller the size of a river is turning in a river, you can easily see that the water in the river will be accelerated.

Now imagine that every one thousand feet along the Houston Ship Channel from downtown Houston to the start of the bay system into the Gulf of Mexico we put a water jet thruster package into the water. It is a distance of about 20 miles. That would be about 5 thruster packages per mile or about 100 thruster packages. Now assume in the normal flood situation, the waters are being carried away from downtown Houston, down the Houston Ship Channel, at approximately 3 miles per hour. The speed is a balance between the energy provided by the water and the frictional forces resisting it.

Now assume that we have enough thrusters and we put enough power in each of the thrusters to increase the speed of the water to 6 miles per hour. If we literally increase the speed of the water in the Houston Ship Channel from 3 miles per hour to 6 miles per hour, we increase the flow rate from about 150 million cubic feet per hour to about 300 million cubic feet per hour and the flood disappears. The thrusters will take a small percentage of the flowing water into them and accelerate it out to a higher speed such as 30 miles per hour. When this accelerated water merges back into the flowing water, the average speed of all the water flowing will be increased.

The better scenario isn't that we turn on the thrusters and cause the flood to go away, but when the rain comes we turn on the thrusters and the flood never happens in the first place.

If the estimate of water at flood stage in Buffalo Bayou from Houston is a minimum of 36 feet deep, 300 feet wide at the surface, 228 feet wide at the bottom and the water flowing at the rate of 3 miles per hour, that would mean that a total of 1,003,622 cubic feet of water would be flowing, or 62,626,037,760 lbs. of water would be flowing. If the bayou slopes 24' in 20 miles, it drops 1.2 feet per mile or 3.6 feet in one hour, or 0.000682 feet per minute. The energy derived is 0.000682 feet times 62,626,037,760 lbs. or 42,699,571 feet-pounds per minute. This divided by 33,000 gives 1,294 horsepower.

If the power required is a function of the square of the velocity, and the system method is only 50% efficient, then 1294*4/0.5=10352 horsepower. If we divide the 10352 horsepower by the 100 thruster stations, we get that each of the thruster stations would require a minimum of 103.5 horsepower.

Referring now to FIG. 1, Buffalo Bayou 1 flows from west of Downtown Houston 2 thru a bay system into the Gulf of Mexico 3. White Oak Bayou 4 flows into Buffalo Bayou 1 at the confluence 5. Brays Bayou 6 flows by the University of Houston 7 and intersects Buffalo Bayou at 8.

A multiplicity of thrusters 10-14 are shown in Buffalo Bayou 1, the lower end of Buffalo Bayou actually being the Houston Ship Channel 9. The thrusters 10-14 are shown above the water level in normal conditions in FIG. 1.

Figure 2:
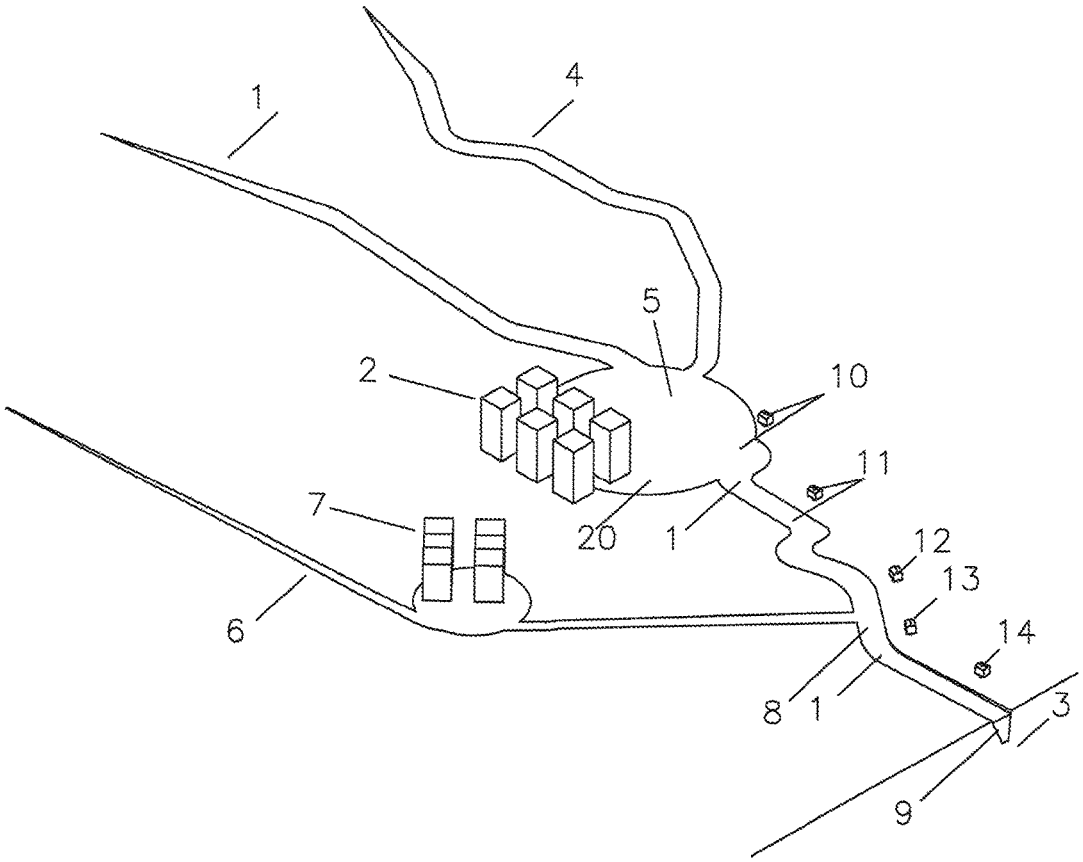

Referring now to FIG. 2, generally in the area of the confluence 5 of Buffalo Bayou 1 and White Oak Bayou, major storms happened in the summer of 2001 and in 2017, causing more water to fall than Buffalo Bayou 1 could carry off to the Gulf of Mexico. As a direct result, a major flooding occurred generally in the area of the confluence of Buffalo Bayou and White Oak Bayou 5. Flooding 20 proceeded into downtown Houston 2 causing massive damage. Additionally, as Buffalo Bayou 1 was carrying as much water as it could carry, any rain falling onto the area of Brays Bayou 6 near the University of Houston had no means of flowing away, but simply collected. This resulted in major flooding in the area of the University of Houston, resulting in approximately $250 million dollars in damages.

Figure 3:
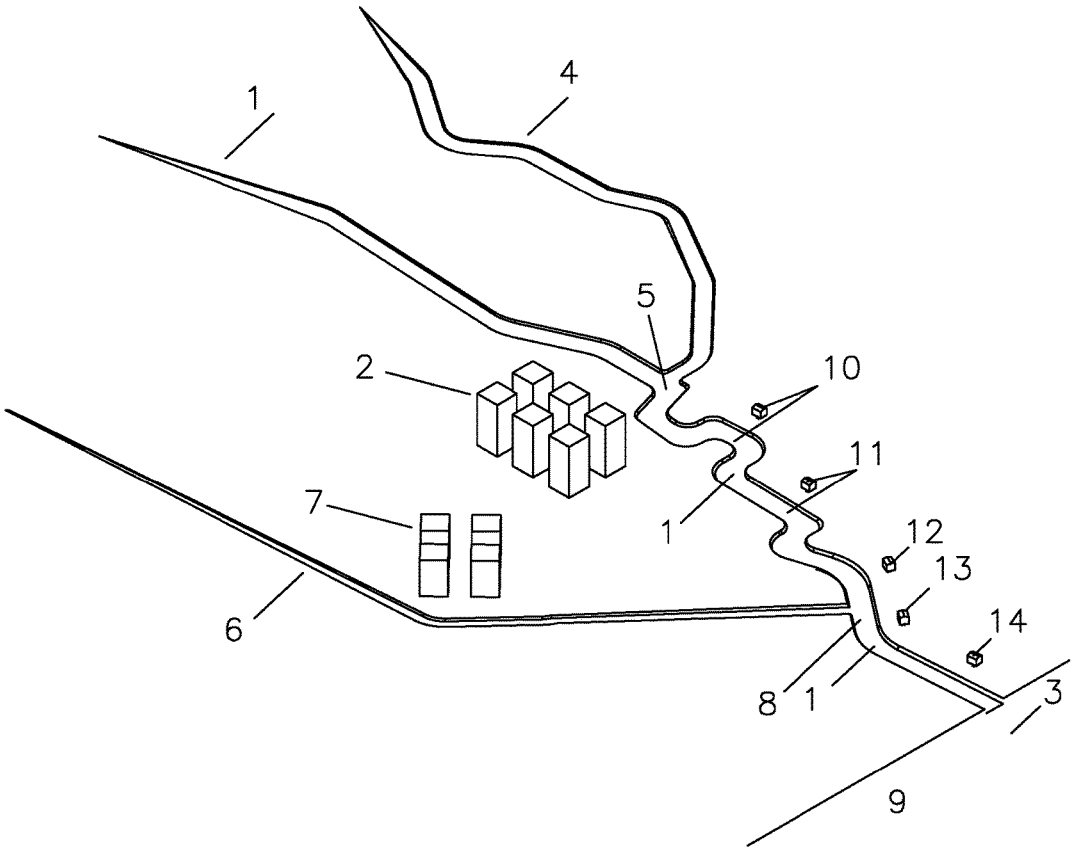

Referring now to FIG. 3, the thrusters of this invention have been turned on, causing the waters in Buffalo Bayou to flow faster. This results first in the flooding 20 in downtown Houston 2 being alleviated. Secondly, if also implemented, as the waters in Brays Bayou 6 now have someplace to flow, the flooding at the University of Houston 7 is eliminated. Although not shown on the figures, flooding also occurred along White Oak Bayou 4 which would not have happened if the methods of this invention had been applied.

Figure 4:
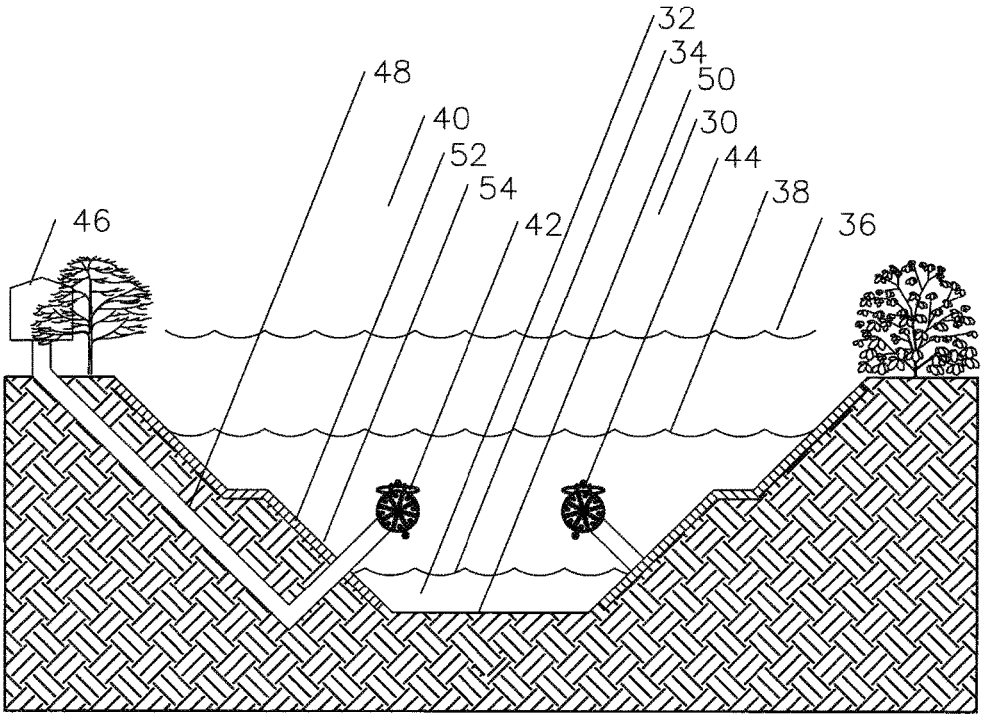
FIG. 4 is a cross section of a waterway or other drainage channel with thrusters of the invention in place.
Figure 5:
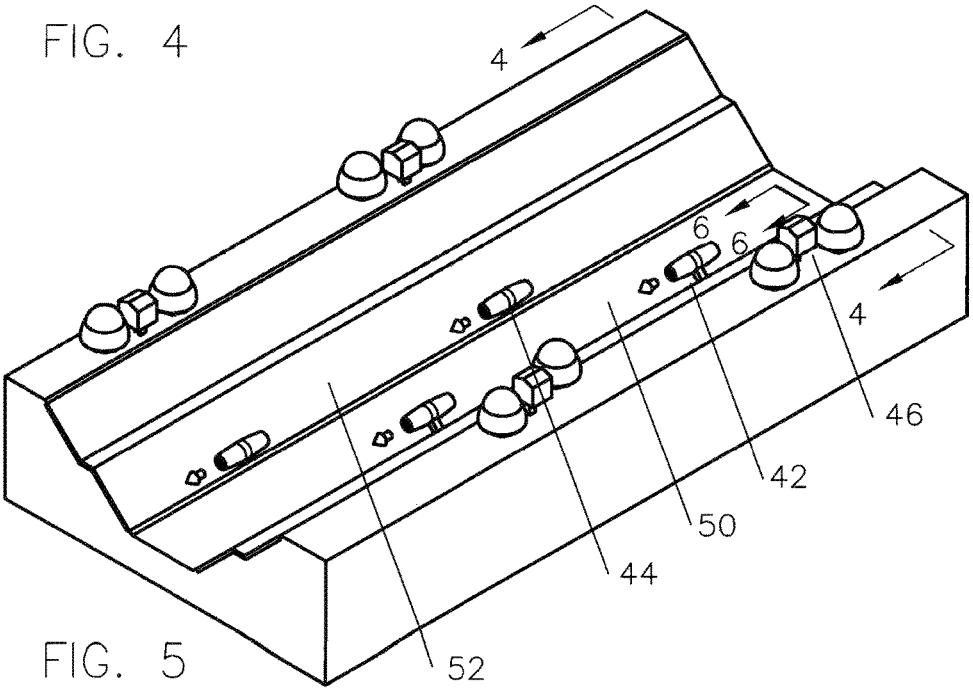
FIG. 5 shows a perspective of thrusters of this invention as it would be when the flood waters are being jetted downstream.

Referring now to FIG. 4, as taken along lines "4-4" of FIG. 5, a bayou or river 30 is shown with water 32 flowing at a normal level 34, flood level waters are shown at 36, and intermediate level of water is shown at 38. The intermediate level of water 38 is the maximum anticipated water level with this invention installed. A thruster system is shown at 40 with the thrusters 42 and 44 at a level above the normal flow of water at 34, but in the water below levels 36 and 38. A motor house is shown at 46, with power being conducted through shaft 48 to the thruster 42.

The thruster 42 is effectively shown being mounted generally parallel to the center of the water way. In actual practice, benefits will be seen from having thrusters on opposite sides of the waterway and inclined rotated slightly toward the center of the waterway to optimize the addition of kinetic energy to the water in preference to added bank friction. Bottom of the bayou or river 30 is shown at 50 and the side is shown at 52. Revetments are shown at 54 which are generally one-foot cube concrete blocks interlaced with steel cable to reinforce the bank against erosion which still allowing green grass to grow. Alternately the sides of the waterway can be lined with concrete to prevent erosion.

Referring now to FIG. 5, a perspective of a thruster of this invention as it would be when the flood waters are being jetted downstream without the water being shown.

Figure 6:
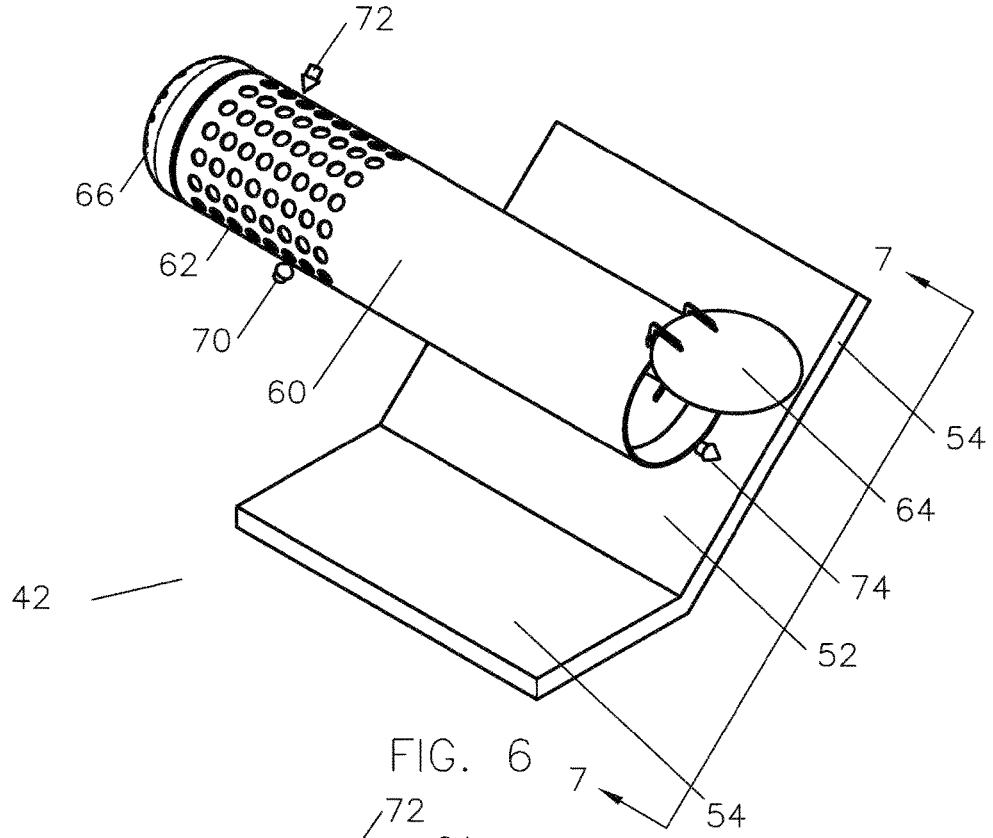
FIG. 6 shows a perspective of a thruster of this invention generally viewed from the downstream end while it is jetting.

Referring now to FIG. 6 which is generally taken along lines "6-6" of FIG. 5, the thruster 42 is shown with outer housing 60 having a multiplicity of inlet holes 62 along the upstream, outlet check valve 64, and upstream dome 66. Arrows 70 and 72 illustrate water entering the outer housing 60 and arrow 74 illustrates water exiting outer housing 60 and being jetted downstream. In this case the flowing water is pushing the outlet check valve 64 open against gravity. When the flow 74 stops, outlet check valve 64 will close automatically.

Figure 7:
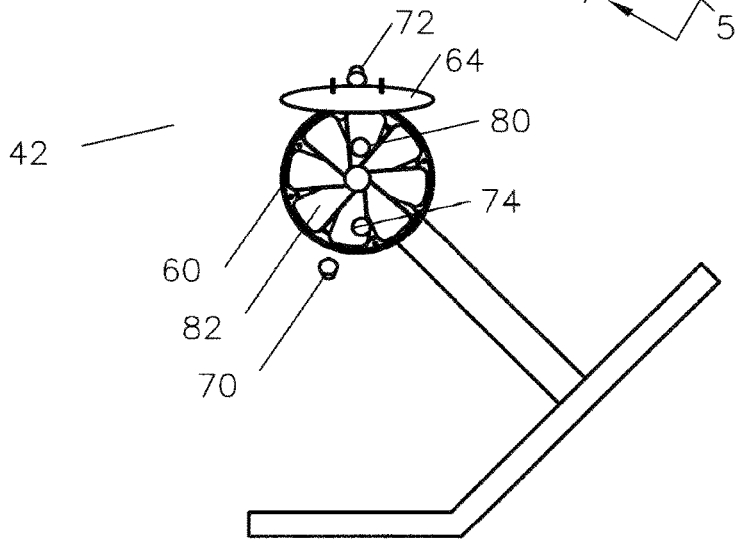
FIG. 7 shows an end view of a thruster of this invention from the downstream end while it is jetting.

Referring now to FIG. 7, a view of the thruster 42 is seen from downstream generally along the lines "7-7" in FIG. 6. In addition to the parts shown in FIG. 5, a second flow arrow 80 is shown along with the impeller blades 82.

Figure 8:
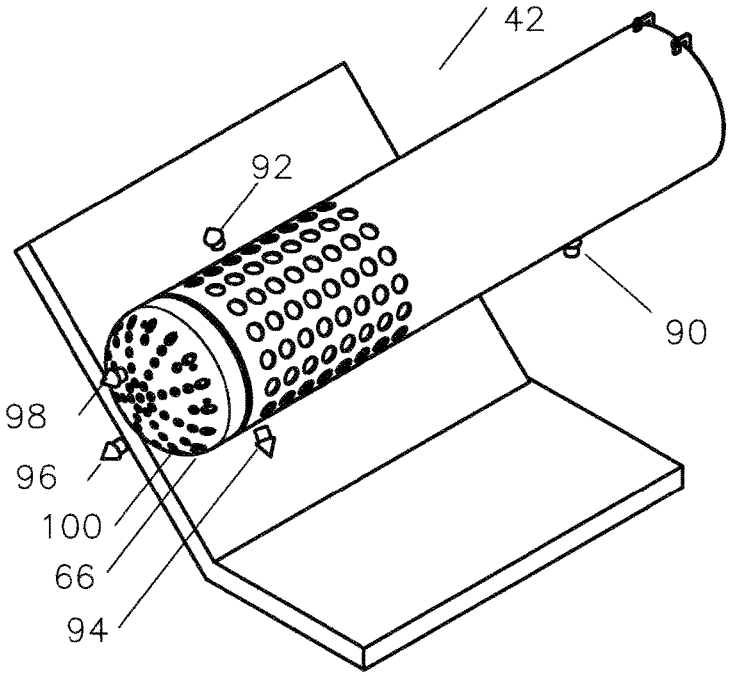
FIG. 8 shows a perspective of a thruster of this invention similar to FIG. 6 except from the upstream side and showing reversed flow through the thruster.

Referring now to FIG. 8, a perspective of a thruster 42 is illustrated showing the upstream end and illustrating water being reversed to clean the inlets. Water is not entering from the bottom as indicated by arrow 90 and exits as indicated by arrows 92-98. Water being blown out of holes 62 as shown by arrows 92 and 94 will tend to release any debris which has collected on the side holes. Water being blown out of holes 100 as shown by arrows 96 and 98 will tend to lift anything off the dome 66 and cause it to float away. A very difficult item to deal with is a large tarp which is floating in the water and hits the upstream end, specifically wrapping around dome 66. Flow as shown by arrows 96 and 98 will cause a layer of water much like a liquid bearing to form over the dome, eliminating retaining friction and cause the tarp to slide off the dome. Holes 100 do not represent water inlets during normal operations as will be seen later.

The decision to reverse the flow and clean the inlets can be made in a variety of ways. Some of the ways might be to monitor the suction pressure within chamber 126 and when it exceeds a desire value do a cleaning reversal, doing it at predetermined timed intervals, signaling the operation by remote control.

Figure 9:
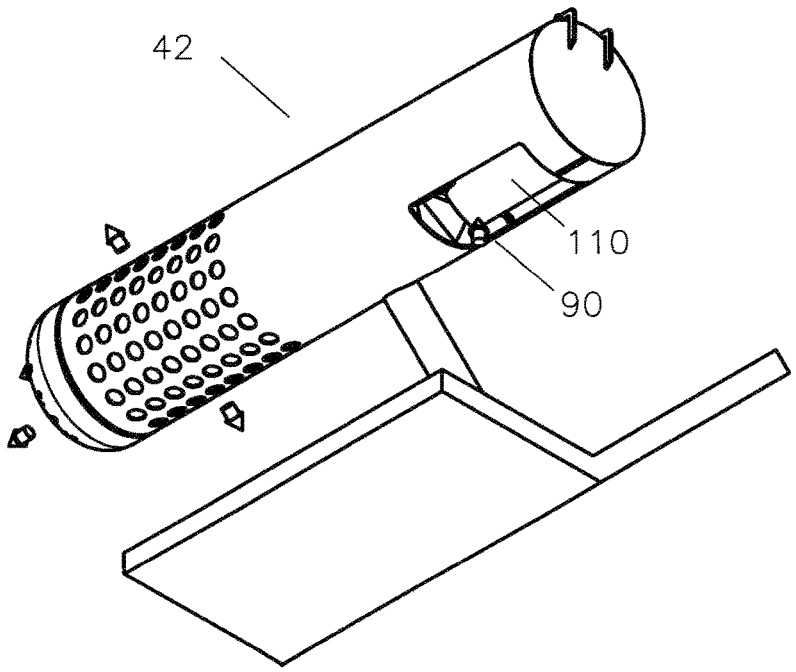
FIG. 9 shows a perspective of a thruster of this invention similar to FIG. 8 except from the lower side and showing a lower check valve being opened by the flow.

Referring now to FIG. 9, a perspective of thruster 66 similar to FIG. 6 except from the lower side and from the outlet end. Lower check valve 110 is opened by the reverse flow allowing reverse circulation.

Figure 10:
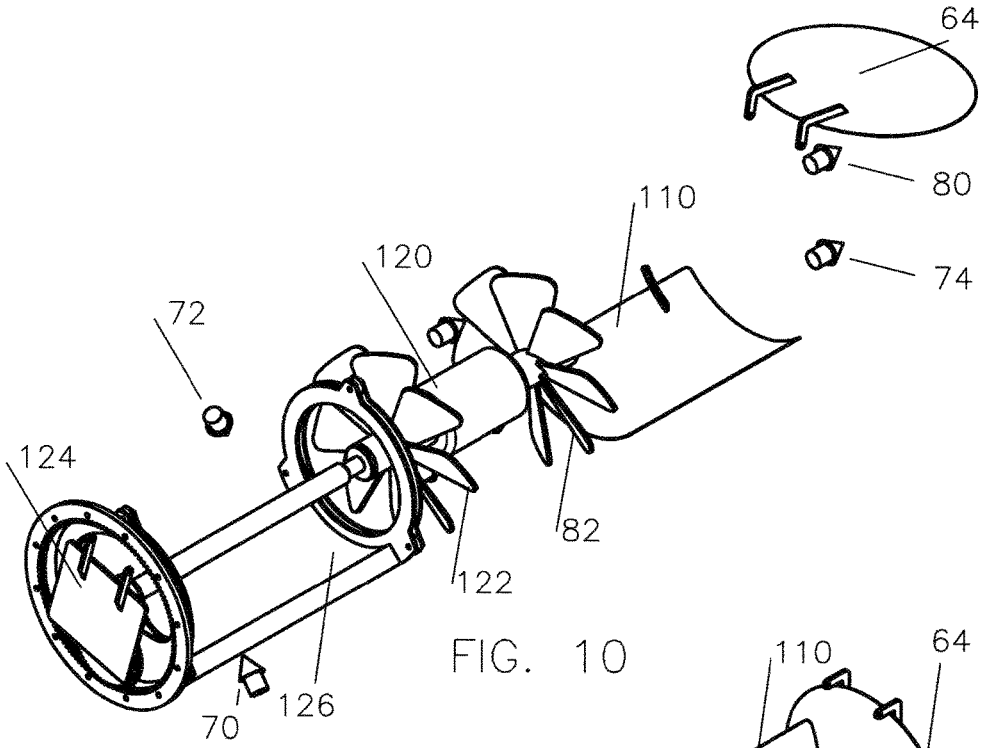
FIG. 10 shows a perspective of a thruster of this invention similar to FIG. 8 with the outer housing removed for clarity and the water flowing through in the jetting direction.

Referring now to FIG. 10, a perspective of a thruster 42 is shown similar to FIG. 8 with the outer housing 60 removed for clarity. The flow arrows are shown similar to FIG. 6 in the normal operation mode. Lower check valve 110 is closed both by gravity and the flow and outlet check valve 64 is pushed open by the flow. Central motor or gearbox 120 is shown and a second set of impellers 122 is seen. Upstream check valve 124 is closed by gravity and by flow. It is closed against a mating plate with a hole (not shown) in the dome 66 by both gravity and the suction which will occur in chamber 126 during normal flow.

Figure 11:
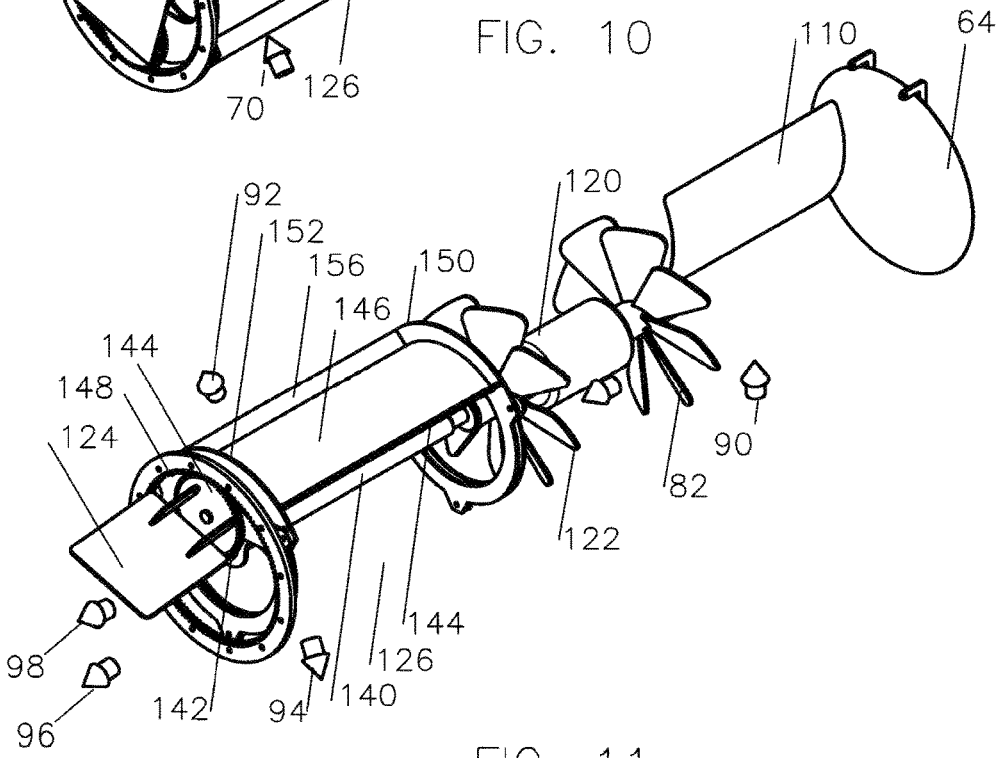
FIG. 11 shows a perspective of a thruster of this invention similar to FIG. 10 with the outer housing removed for clarity and the water flowing through in the reversed cleaning direction.

Referring now to FIG. 11, a perspective of a thruster 42 is shown similar to FIG. 10 with the outer housing 60 removed for clarity. The flow arrows are shown similar to FIG. 8 when flow is reversed for cleaning. Lower check valve 110 is opened by the flow and outlet check valve 64 is closed by both suction and gravity. Upstream check valve 124 is opened by the flow. In this way the reversed flow is introduced to dome 66 as seen in FIG. 8 to introduce the fluid bearing on dome 100. Shaft 140 extends from motor or gearbox 120 which the impellers 82 and 122 rotate. Gear 142 is on the end of shaft 140 and engages planetary gear 144 which is mounted on blocker 146. Planetary gear 144 engages internal gear 148, which is stationary. This causes planetary gear 144 to rotate about the center of the housing 60 and similarly to rotate blocker 146 about the center of housing 60. Blocker 146 has edges 150-156 which closely fit or seal to the internal bore of housing 60, allowing blocker 146 to block the flow coming in a portion of the holes 62 in housing 60. This provides in normal operation for debris which might block a portion of the holes 62 to be released without having to reverse the flow. In this way continuous and intermittent cleaning of the inlets of thruster 42 are achieved.

The particular thruster embodiment shown in the figures is a series of propellers mounted in a cylindrical housing. Any number of embodiments for a thruster can be utilized in this service, such as a single open propeller, gear pumps, or piston pumps.

As the water level rises in the waterway, various means such as floats or pressure sensors can be utilized to automatically turn the engine on to drive the thruster until the water level drops satisfactorily. Additionally, remote or radio-controlled means can be easily utilized to start, stop, or regulate the speed of the thrusters.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

NUMBERS IN SPECIFICATION—TRASH

Buffalo Bayou 1
Downtown Houston 2
Gulf of Mexico 3
White Oak Bayou 4
confluence 5
Brays Bayou 6
the University of Houston 7
intersects Buffalo Bayou at 8
multiplicity of thrusters 10-14
Houston Ship Channel 9
Flooding 20
bayou or river 30
water 32
normal level 34
flood level waters 36
inter. level of water is shown at 38
thruster system is shown at 40
thrusters 42 and 44
motor house is shown at 46
shaft 48
Bottom 50
side is shown at 52
Revetments are shown at 54
outer housing 60
multiplicity of inlet holes 62 outlet check valve 64, and upstream dome 66
Arrows 70 and 72
arrow 74
second flow arrow 80
impeller blades 82
arrow 90
arrows 92-98
holes 100
arrows 96 and 98
dome 66
Holes 100
chamber 126
Lower check valve 110
motor or gearbox
second set of impellers 122
Upstream check valve 124
chamber 126
Shaft 140
impellers 82 and 122 rotate
Gear 142
planetary gear 144
blocker 146
internal gear 148
blocker 146
edges 150-156
internal bore

I claim:

1. A method for cleaning the inlet for one or more thrusters increasing the velocity of flowing waters in a channel in a first direction comprising using said one or more thrusters to draw a portion of said waters into one or more inlets of said one or more thrusters and increasing the velocity of said portion of said waters in a first direction within said one or more thrusters and sending said portion of said waters with said increased velocity out of one or more outlets, said one or more thrusters having a housing with a centerline, mixing said portion of said waters with said increased velocity back into the remainder of said waters to increase the average velocity of said waters in said first direction, and cleaning one or more of said one or more inlets of debris without slowing said flowing water in said channel by reversing the flow in said one or more thrusters in said first direction by drawing said portion of said waters into said one or more thrusters at proximately ninety degrees to said first direction and discharging said portion of said waters through said inlets at proximately ninety degrees from said first direction.

2. The invention of claim 1, further comprising said cleaning one or more of said one or more inlets of debris begins automatically.

3. The invention of claim 2, further comprising said cleaning of said inlet to said one or more thrusters when the suction pressure in said inlet is more than a predetermined value.

4. The invention of claim 2, further comprising said initiating of said cleaning of said one or more inlets to said one or more thrusters when the suction pressure in said one or more inlets is less than a predetermined value.

5. The invention of claim 1, further comprising cleaning one or more inlets to said one or more thrusters while said waters are in motion relative to said thruster.

6. The invention of claim 1, further comprising cleaning said one or more inlets of debris while said water outside of said housing in said one or more thruster is flowing proximately in said first direction.

7. The invention of claim 6, further comprising said cleaning occurs by providing a blocker within said housing to block a portion of the said one or more inlets of said one or more thrusters to allow unassisted flow outside said housing of said one or more thrusters to clean said one or more inlets which are blocked.

8. The invention of claim 7, further comprising moving said blocker to alternate the portions of said one or more inlets.

9. The invention of claim 8, further comprising rotating said blocker about a rotational axis or said centerline to alternate said portions of said one or more inlets.

10. The invention of claim 1, further comprising cleaning said one or more inlets of debris while said water in said one or more thrusters is flowing in a second direction which is proximately opposite said first direction.

11. The invention of claim 10, further comprising cleaning a portion of said one or more thrusters which is not said one or more inlets.

12. A method for the prevention or remediation of flooding waters in a geographic area comprising using one or more thrusters to draw a portion of said waters into one or more inlets to increase the velocity of said portion of said waters and send said portion of waters out of one or more outlets in a first direction, said one or more thrusters having a housing with a centerline, mixing said portion of said waters back in to the remainder of said waters in said geographic area increasing the average velocity of said waters in said geographic area in said first direction from an unassisted velocity to an assisted velocity thereby increasing the rate of removal of said waters from said geographic area, and cleaning one or more inlets to said one or more thrusters of debris without slowing said flowing water in said geographic area in said first direction by reversing the flow in said one or more thrusters by drawing a portion of said waters into said one or more thrusters at proximately ninety degrees to said first direction and discharging said portion of said waters through said one or more inlets at proximately ninety degrees from said first direction.

13. The invention of claim 12, further comprising receiving said portion of said waters proximately radially into said one or more thrusters.

14. The invention of claim 12, further comprising reversing the flow of said one or more thrusters to initiate said cleaning.

15. The invention of claim 14, further comprising said initiating cleaning of said one or more inlets to said one or more thrusters when the suction pressure in said one or mere inlets exceeds a predetermined value.

16. The invention of claim 14, further comprising directing a portion of said flow of said one or more thrusters proximately axially of said one or more thruster.

17. The invention of claim 14, further comprising cleaning a portion of said one or more thrusters which was not said one or more inlets.

18. The invention of claim 12, further comprising said cleaning occurs by providing a blocker within said housing to block a portion of the said one or more inlets of said one or more thrusters to allow unassisted flow outside said one or more thrusters to clean said one or more inlets which are blocked.

19. The invention of claim 18, further comprising moving said blocker to alternate the portions of said one or more inlets.

20. The invention of claim 18, further comprising rotating said blocker to alternate the portion of said one or more inlets.

21. A method for the prevention or remediation of flooding waters in a channel or geographic area comprising cleaning one or more inlets to said thrusters while said flooding waters are in motion relative to said one or more thrusters, using said one or more thrusters to increase the velocity of a portion of said flooding waters within said one or more thrusters and sending said portion of waters out of one or more outlets, said one or more thrusters having a housing with a centerline, mixing said portion of said flooding waters back into the remainder of said flooding waters in said channel or geographic area increasing the average velocity of said flooding waters in said channel or geographic area thereby increasing the rate of removal of said flooding waters from said channel or geographic area, and said thrusters having said one or more inlets proximately at ninety degrees from said centerline.

22. The invention of claim 21, further comprising reversing the flow of said one or more thrusters to initiate said cleaning.

23. The invention of claim 22, further comprising said cleaning of said inlet to said one or more thrusters when the suction pressure in said inlet is below a predetermined value.

24. The invention of claim 22, further comprising said initiating of said cleaning of said one or more inlets to said one or more thrusters when the suction pressure in said one or more inlets is more than a predetermined value.

25. The invention of claim 23, further comprising directing a portion of said reversed flow of said one or more thrusters proximately axially of said one or more thrusters.

26. The invention of claim 21, further comprising said cleaning occurs by providing a blocker to block a portion of the said one or more inlets of said one or more thrusters to allow unassisted flow outside said one or more thrusters to clean said one or more inlets which are blocked.

27. The invention of claim 26, further comprising moving said blocker to alternate the portions of said one or more inlets which are being cleaned.

28. The invention of claim 26, further comprising rotating said blocker to alternate the portion of said one or more inlets about said rotational axis or centerline which are being cleaned.

29. The invention of claim 22, further comprising cleaning a portion of said one or more thrusters which was not said one or more inlets.

* * * * *